US008113965B2

(12) United States Patent
Ban

(10) Patent No.: US 8,113,965 B2
(45) **Date of Patent: *Feb. 14, 2012**

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,112

(22) Filed: Mar. 16, 2010

(65) Prior Publication Data

US 2010/0317459 A1 Dec. 16, 2010

(30) Foreign Application Priority Data

Jun. 16, 2009 (JP) ..... 2009-143671

(51) Int. Cl.
*A63B 53/04* (2006.01)

(52) U.S. Cl. ..... 473/330; 473/331

(58) Field of Classification Search ..... 473/324–350, 473/287–292

See application file for complete search history.

(56) References Cited

U.S. PATENT DOCUMENTS

| | | | | |
|---|---|---|---|---|
| 1,965,954 | A | 7/1934 | Davis | |
| 3,869,126 | A | 3/1975 | Thompson | |
| 4,768,787 | A * | 9/1988 | Shira | 473/331 |
| 5,029,864 | A | 7/1991 | Keener | |
| 5,190,289 | A * | 3/1993 | Nagai et al. | 473/327 |
| 5,437,088 | A | 8/1995 | Igarashi | |
| 5,618,239 | A | 4/1997 | Rife | |
| 5,688,190 | A | 11/1997 | Rowland et al. | |
| 5,690,561 | A | 11/1997 | Rowland et al. | |
| 5,709,616 | A | 1/1998 | Rife | |
| 5,792,004 | A | 8/1998 | Nagamoto | |
| 7,273,422 | B2 | 9/2007 | Vokey et al. | |
| 7,674,188 | B2 * | 3/2010 | Ban | 473/330 |
| 7,780,548 | B2 * | 8/2010 | Solheim | 473/330 |
| 7,819,756 | B2 * | 10/2010 | Ban et al. | 473/330 |
| 7,828,671 | B2 * | 11/2010 | Ban | 473/331 |
| 7,901,297 | B2 * | 3/2011 | Ban et al. | 473/331 |
| 2005/0130761 | A1 | 6/2005 | Vokey et al. | |
| 2005/0245329 | A1 | 11/2005 | Nishitani et al. | |
| 2005/0250594 | A1 | 11/2005 | Nishitani et al. | |
| 2008/0020859 | A1 | 1/2008 | Yamagishi et al. | |
| 2008/0045351 | A1 | 2/2008 | Vokey et al. | |
| 2008/0125241 | A1 | 5/2008 | Tateno et al. | |
| 2008/0125242 | A1 | 5/2008 | Ban | |
| 2008/0125243 | A1 | 5/2008 | Ban | |
| 2008/0132351 | A1 | 6/2008 | Ban et al. | |
| 2008/0132352 | A1 | 6/2008 | Ban | |
| 2009/0176597 | A1 | 7/2009 | Yamagishi et al. | |

FOREIGN PATENT DOCUMENTS

| | | | |
|---|---|---|---|
| JP | 08-000777 | A | 1/1996 |
| JP | 08-206260 | A | 8/1996 |
| JP | 08-229169 | A | 9/1996 |
| JP | 09-056855 | A | 3/1997 |
| JP | 09-070457 | A | 3/1997 |
| JP | 09-099120 | A | 4/1997 |

(Continued)

*Primary Examiner* — Sebastiano Passaniti
(74) *Attorney, Agent, or Firm* — Sughrue Mion, PLLC

(57) ABSTRACT

This invention provides a golf club head comprising a plurality of scorelines formed in its face. The golf club head is configured such that an angle θ of the side wall of the scoreline with respect to the face is 70° or less, the edge of the scoreline has a ridged portion projecting from the face, and a height H of the ridged portion from the face satisfies: 5 μm≦H≦20 μm.

3 Claims, 8 Drawing Sheets

FOREIGN PATENT DOCUMENTS

| | | | |
|---|---|---|---|
| JP | 09-253250 | A | 9/1997 |
| JP | 10-000250 | A | 1/1998 |
| JP | 10-000251 | A | 1/1998 |
| JP | 10-248974 | A | 9/1998 |
| JP | 02825022 | B2 | 9/1998 |
| JP | 02926702 | B2 | 5/1999 |
| JP | 2002-000779 | A | 1/2002 |
| JP | 2004-000674 | A | 1/2004 |
| JP | 2005-169129 | A | 6/2005 |
| JP | 2005-312619 | A | 11/2005 |
| JP | 2005-319019 | A | 11/2005 |
| JP | 2008-023178 | A | 2/2008 |
| JP | 2008-132168 | A | 6/2008 |
| JP | 2008-132169 | A | 6/2008 |
| JP | 2008-136619 | A | 6/2008 |
| JP | 2008-136833 | A | 6/2008 |

* cited by examiner

FIG. 7

| | CROSS-SECTIONAL SHAPE | θ (°) | H (μm) | W (mm) | Ra (μm) | P (mm) | A ($mm^2$) |
|---|---|---|---|---|---|---|---|
| #1 | SINGLE-STEP SIDE WALL | 75 | — | 0.85 | 1.5 | 3.6 | 0.382 |
| #2 | TWO-STEP SIDE WALL | 35 | — | | | | 0.202 |
| #3 | | 45 | — | | | | 0.245 |
| #4 | | 35 | 5 | | 2.5 | | 0.202 |
| #5 | | | | | 3.5 | | |
| #6 | | | | | 6.0 | | |
| #7 | | | 15 | | 1.5 | | |
| #8 | | | 20 | | | | |
| #9 | | | 25 | | | | |
| #10 | | 45 | 3 | | | | 0.245 |
| #11 | | | 6 | | | | |
| #12 | | | 10 | | | | |
| #13 | | | 15 | | | | |

FIG. 8

<table>
<tr><th rowspan="2"></th><th colspan="3">RULE CONFORMITY</th><th colspan="2">EXPERIMENTAL RESULT</th></tr>
<tr><th>AREA RULE</th><th>TWO-CIRCLE RULE</th><th>SURFACE ROUGHNESS RULE</th><th>BACK SPIN AMOUNT</th><th>SCRATCH</th></tr>
<tr><td>#1</td><td>×</td><td>×</td><td rowspan="5">○</td><td>A</td><td>E</td></tr>
<tr><td>#2</td><td rowspan="12">○</td><td rowspan="7">○</td><td>E</td><td>A</td></tr>
<tr><td>#3</td><td>D</td><td rowspan="2">B</td></tr>
<tr><td>#4</td><td>C</td></tr>
<tr><td>#5</td><td>B</td><td>C</td></tr>
<tr><td>#6</td><td>×</td><td>A</td><td>D</td></tr>
<tr><td>#7</td><td rowspan="8">○</td><td>C</td><td>B</td></tr>
<tr><td>#8</td><td rowspan="2">B</td><td>C</td></tr>
<tr><td>#9</td><td>×</td><td>E</td></tr>
<tr><td>#10</td><td rowspan="2">○</td><td>D</td><td rowspan="2">B</td></tr>
<tr><td>#11</td><td rowspan="2">C</td></tr>
<tr><td>#12</td><td>×</td><td>D</td></tr>
<tr><td>#13</td><td>×</td><td>B</td><td>E</td></tr>
</table>

GOLF CLUB HEAD

BACKGROUND OF THE INVENTION

1. Field of the Invention

The present invention relates to a golf club head and, more particularly, to scorelines in the face.

2. Description of the Related Art

In general, a plurality of linear grooves are formed in the face of a golf club head so as to run parallel to each other in the toe-to-heel direction (see, for example, Japanese Patent Laid-Open Nos. 10-248974 and 2005-169129). These grooves are called, for example, scorelines, marking lines, or face lines (these grooves will be referred to as scorelines in this specification). These scorelines have the effect of increasing the amount of backspin on a struck golf ball, or suppressing a significant decrease in the amount of backspin on a struck golf ball upon a shot in rainy weather or that from the rough.

Typically, as an angle θ of the side wall of the scoreline with respect to the face widens, the amount of backspin on a struck ball can increase but the golf club head is prone to scratch the ball at the same time.

SUMMARY OF THE INVENTION

It is an object of the present invention to provide a golf club head which can obtain a larger amount of backspin on a ball while being prevented from scratching the ball.

According to the present invention, there is provided a golf club head comprising a plurality of scorelines formed in a face thereof, wherein an angle θ of a side wall of the scoreline with respect to the face is not more than 70°, an edge of the scoreline includes a ridged portion projecting from the face, and a height H of said ridged portion from the face satisfies 5 μm≦H≦20 μm.

Further features of the present invention will become apparent from the following description of exemplary embodiments with reference to the attached drawings.

BRIEF DESCRIPTION OF THE DRAWINGS

FIG. 7 is a table showing the specifications of golf club heads #1 to #13 used in the experiment involved;

FIG. 8 is a table showing the rule conformities of golf club heads #1 to #13 and the experimental results obtained using them.

DESCRIPTION OF THE EMBODIMENTS

First Embodiment

Figure 1:
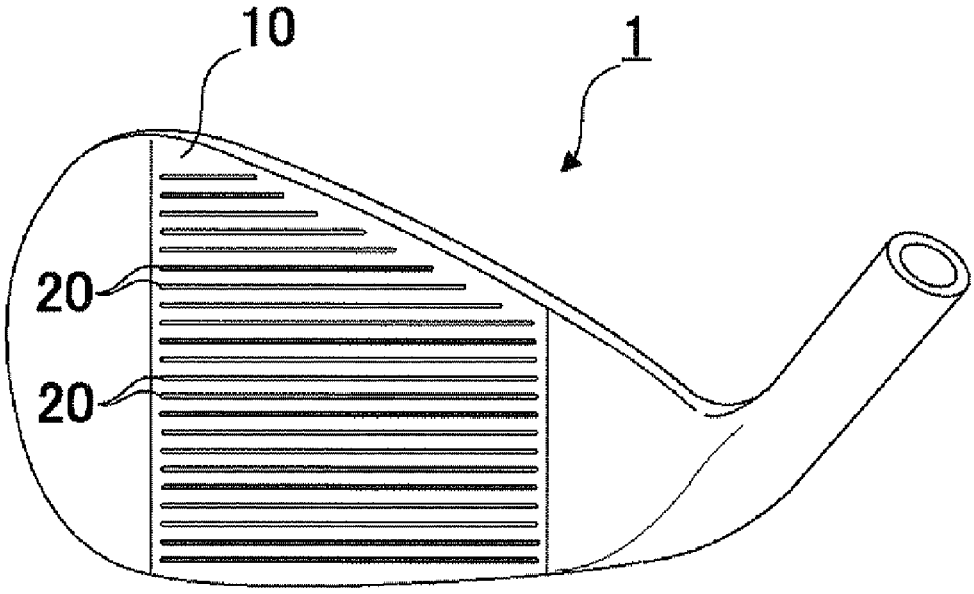
FIG. 1 is a perspective view of a golf club head 1 according to one embodiment of the present invention.

FIG. 1 is a perspective view of a golf club head 1 according to one embodiment of the present invention. FIG. 1 exemplifies a case in which the present invention is applied to an iron type golf club head. The present invention is suitable for an iron type golf club head and, more particularly, for middle iron, short iron, and wedge type golf club heads. More specifically, the present invention is suitable for a golf club head with a loft angle of 25° (inclusive) to 70° (inclusive) and a head weight of 200 g (inclusive) to 320 g (inclusive). However, the present invention is also applicable to wood type and utility type golf club heads.

The golf club head 1 has a plurality of scorelines 20 formed in its face (its striking surface or striking face) 10. The scorelines 20 are linear grooves running parallel to each other in the toe-to-heel direction. Although the scorelines 20 run at equal intervals (equal pitches) in this embodiment, they may run at different intervals.

Figure 2:
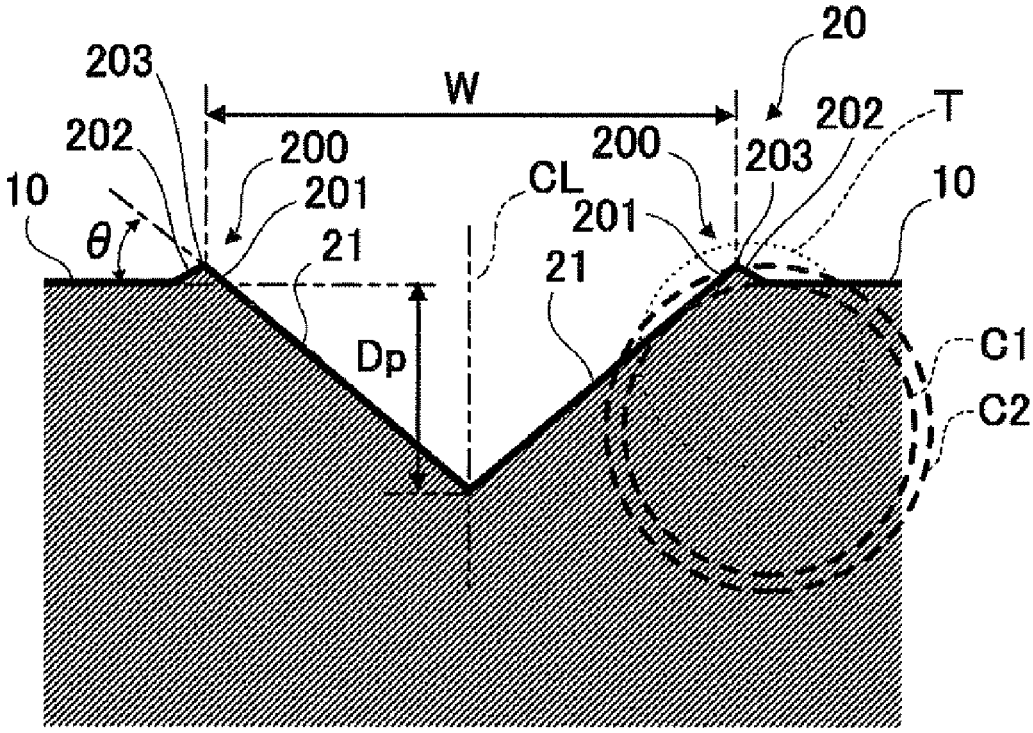
FIG. 2 is a sectional view of a scoreline 20 in a direction perpendicular to its longitudinal direction (toe-to-heel direction)

FIG. 2 is a sectional view of the scoreline 20 in a direction perpendicular to its longitudinal direction (toe-to-heel direction). In this embodiment, the cross-sectional shapes of the scoreline 20 are the same in its portions other than its two end portions (its toe-side end portion and heel-side end portion). In addition, the cross-sectional shapes of the scorelines 20 are the same.

The scoreline 20 has a pair of side walls 21. The side wall 21 forms a single face. The lower ends of the pair of side walls 21 are continuous with each other and therefore the scoreline 20 has a roughly V-shaped cross-section. The cross-sectional shape of the scoreline 20 is bilaterally symmetrical about its center line CL. A depth Dp is the distance from the face 10 to the deepest portion of the scoreline 20. A width W is of the scoreline 20 and is measured by the so-called 30 degrees measurement rule of athletic golf clubs. Since a rule concerning athletic golf clubs imposes limits on the depth Dp and the width W, the golf club head 1 is designed so as to satisfy that rule when it is used for an athletic golf club.

An angle θ is of the side wall 21 with respect to the face 10. In a scoreline without ridged portions 200 (to be described later), typically, if the angle θ is relatively wide, the amount of backspin on a ball is relatively large but the golf club head 1 is prone to scratch the ball at the same time. If the angle θ is relatively narrow, the amount of backspin on a ball is relatively small but the golf club head 1 is less prone to scratch the ball at the same time. In this embodiment, the angle θ is assumed to be 70° or less. Note that, when the angle θ is too narrow, a sufficient amount of backspin cannot be obtained. Thus, the angle θ is preferably 40° or more and is, more preferably, 45° or more.

Figure 3A:
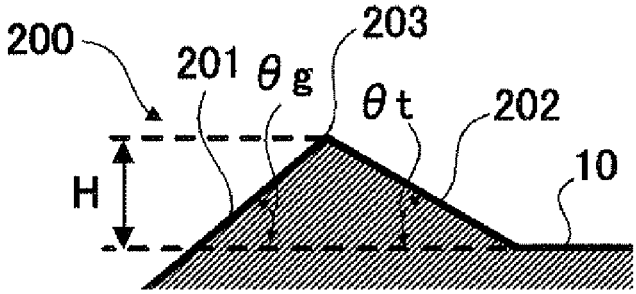
FIG. 3A is an enlarged sectional view of a ridged portion 200.

Ridged portions 200 projecting from the face 10 are formed in the edges of the scoreline 20. The ridged portions 200 are uniformly formed so as to extend in the longitudinal direction of the scoreline 20. FIG. 3A is an enlarged sectional view of the ridged portion 200. In this embodiment, the ridged portion 200 has a triangular cross-section, an inner side wall 201 on the side of the center of the scoreline 20, and an outer side wall 202 on the side opposite to the center of the scoreline 20. Also in this embodiment, the inner side wall 201 and side wall 21 are continuous with each other on nearly the same plane.

In this embodiment, the ridged portions 200 are formed to increase the amount of backspin on a struck ball. That is, as described above, the back spin amount on a struck ball typically increases or decreases nearly in proportion to the angle θ, but the formation of the ridged portions 200 makes it possible to obtain a sufficient amount of backspin even when the angle θ is relatively narrow.

Figure 9A:
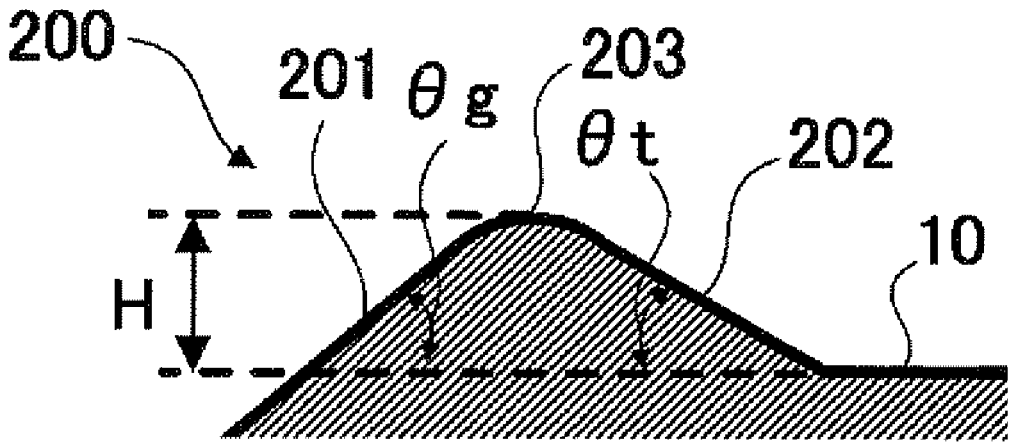
FIGS. 9A and 9B are enlarged sectional views showing other examples of the shape of the ridged portion 200.
Figure 9B:
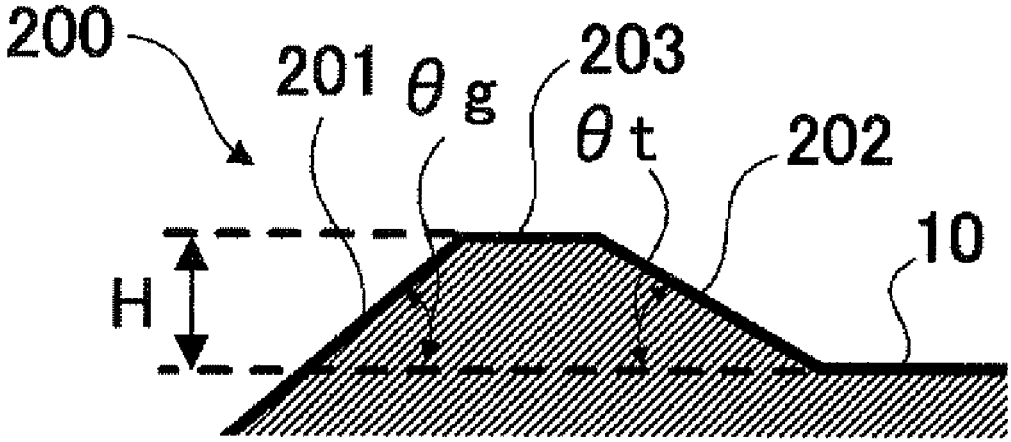

A top 203 of the ridged portion 200 may be rounded off, as shown in FIG. 9A, so that the ridged portion 200 has a roughly triangular cross-section. Also, the top 203 may be shaped into a flat surface, as shown in FIG. 9B, so that the ridged portion 200 has a trapezoidal cross-section.

Referring to FIG. 3A, an angle θg is the interior angle between the face 10 and the inner side wall 201, and an angle θt is the interior angle between the face 10 and the outer side wall 202. To be more precise, the angles θg and θt are the interior angles between a virtual plane including the face 10 and the inner side wall 201 and outer side wall 202, respectively. In this embodiment, the angle θg is equal to the above-mentioned angle θ. Note that θg>θt in this embodiment. When θg>θt, it is advantageously possible to reduce wearing of the ridged portion 200.

A height H is the distance from the face 10 to the top 203. To be more precise, the height H is the length of the normal from the top 203 to a virtual plane including the face 10. As the height H rises, the catchability between a ball and the ridged portion 200 upon striking the ball improves, and the amount of backspin on the ball can, in turn, increase. The height H is desirably 5 μm or more. On the other hand, the height H is too high, the golf club head 1 is prone to scratch a ball. In addition, it is stipulated that the face of an athletic golf club should have a surface roughness equal to a maximum height Ry of 25 μm or less. Thus, the height H is naturally 25 μm or less.

The area rule and two-circle rule concerning athletic golf clubs will be explained next. The area rule stipulates that the cross-sectional area of a scoreline and a pitch P between adjacent scorelines must satisfy: Cross-sectional Area A ($inch^2$)/Pitch P (inch)≦0.003. In accordance with the metric system, this rule is rewritten as: Cross-sectional Area A ($mm^2$)/Pitch (mm)≦0.0762. When the golf club head 1 is used as an athletic golf club head, it is designed so as to satisfy this rule. Note that in this embodiment, the cross-sectional area A is the area of the region surrounded by a virtual line which connects the pair of side walls 21, the pair of side walls 201, and the pair of tops 203. Also, the pitch P is given by: P=W+S where S is the interval between adjacent scorelines. If the interval S between adjacent scorelines differs, the smaller value (the narrower interval) is selected.

The two-circle rule stipulates that the edge of a scoreline generally must fall within a virtual circle which has a radius of 0.011 inches (0.279 mm) and is concentric with a virtual circle which has a radius of 0.010 inches (0.254 mm) and is inscribed in both the side wall of the scoreline and the face. This two-circle rule admits, as an exception, a scoreline which has its edge falling outside a virtual circle with a radius of 0.011 inches but which satisfies the condition in which the included angle between two segments which connect the center of the virtual circle and two intersections between the virtual circle and the contour of the edge of the scoreline falling outside the virtual circle is 10° or less (to be referred to as the "maximum angle rule" hereinafter). However, the edge of the scoreline is prohibited from projecting in excess of 0.0113 inches (0.287 mm) from the center of the virtual circle (to be referred to as the "maximum projection rule" hereinafter). When the golf club head 1 is used as an athletic golf club head, it is designed so as to satisfy these rules.

Figure 3B:
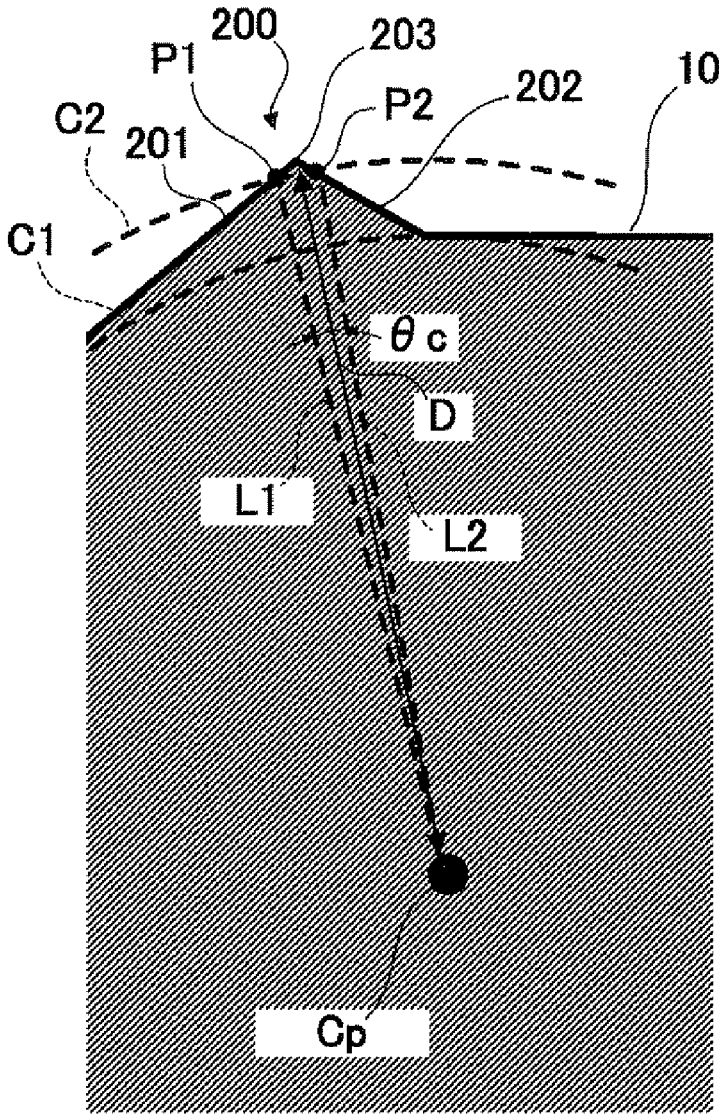
FIG. 3B is an enlarged view of a portion corresponding to a circle T in FIG. 2.

Referring to FIG. 2, a virtual circle C1 is a circle which has a radius of 0.010 inches and is inscribed in both the side wall 21 and the face 10. Also, a virtual circle C2 is a circle which has a radius of 0.011 inches and is concentric with the virtual circle C1. FIG. 3B is an enlarged view of a portion corresponding to a circle T in FIG. 2. A center point Cp is of the virtual circle C1 (and the virtual circle C2). The ridged portion 200 partially falls outside the virtual circle C2 and the contour of the portion falling outside the virtual circle C2 and the virtual circle C2 intersect with each other at points P1 and P2. To satisfy the two-circle rule, an included angle θc between a virtual line L1 which connects the points P1 and Cp and a virtual line L2 which connects the points P2 and Cp needs to be 10° or less. In addition, in this embodiment, since a point farthest from the center point Cp corresponds to the top 203, the distance between the center point Cp and the top 203 needs to be 0.0113 inches or less, that is, the ridged portion 200 needs to fall within a virtual circle (not shown) which has a radius of 0.0113 inches and a center at the center point Cp, in order to satisfy the two-circle rule.

Figure 4A:
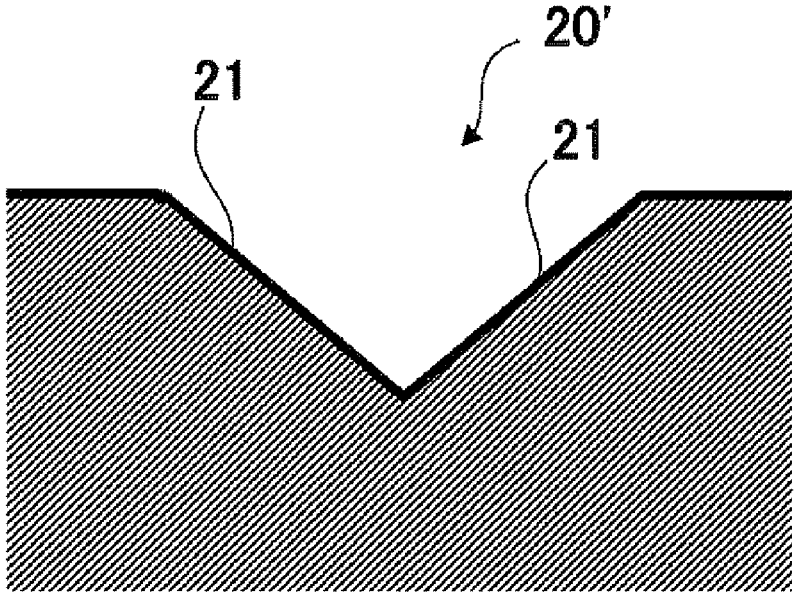
FIGS. 4A and 4B are explanatory views illustrating an example of a method of forming the ridged portions 200.
Figure 4B:
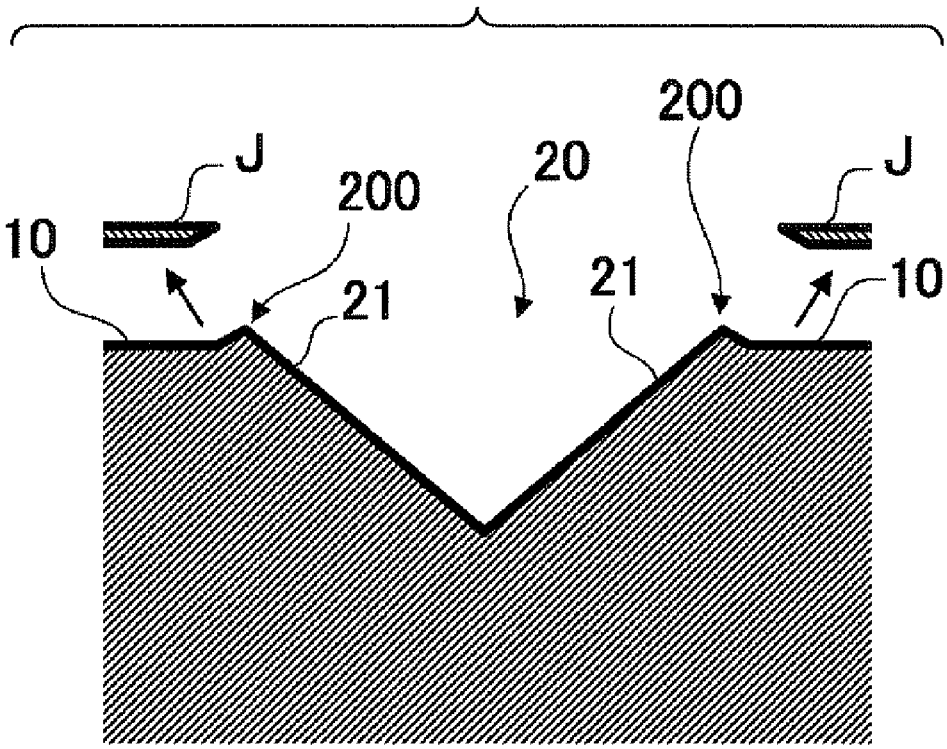

An example of a method of forming the ridged portions 200 will be explained next. FIGS. 4A and 4B are explanatory views illustrating an example of a method of forming the ridged portions 200. First, a face member which forms a face 10 is prepared. This face member is a member which forms a face portion if a golf club head is fabricated by separately forming a face portion and a body portion and assembling them; is a member which forms a body portion if a golf club head is fabricated by separately forming a body portion and a sole portion and assembling them; or is a single member which forms a golf club head if it is formed from that member alone.

Next, a temporary scoreline 20' is primarily formed, as shown in FIG. 4A. Subsequently, unnecessary portions are eliminated to form a face 10 and ridged portions 200. The temporary scoreline 20' can be formed by, for example, a cutting process, a forging process, or a casting process. Examples of a method of eliminating the unnecessary portions J are a cutting process, a polishing process, a shotblasting process, a shot peening process, and chemical processes such as acid washing.

Figure 5A:
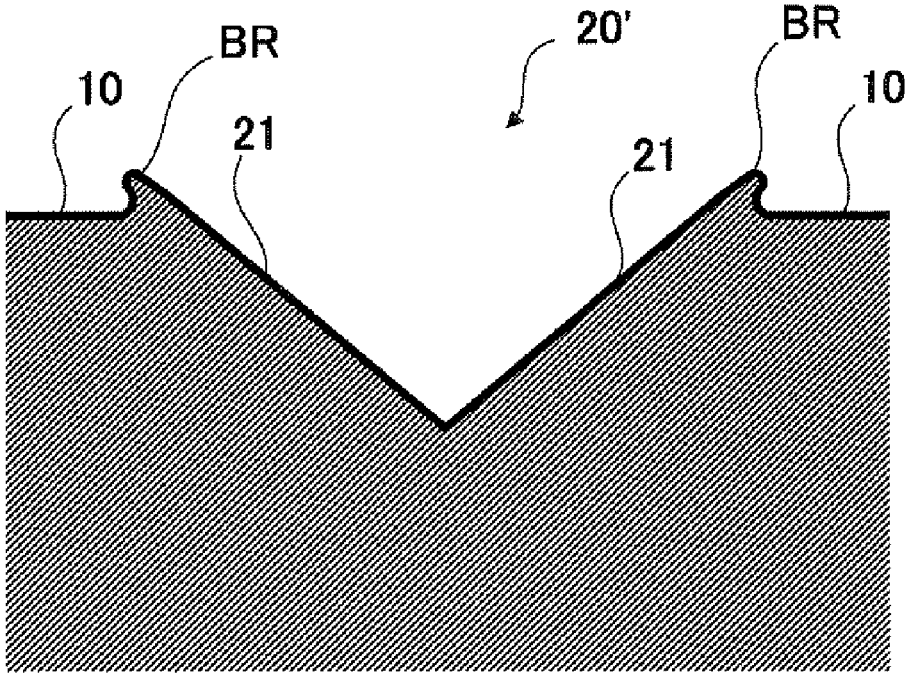
FIGS. 5A and 5B are explanatory views illustrating another example of the method of forming the ridged portions 200.
Figure 5B:
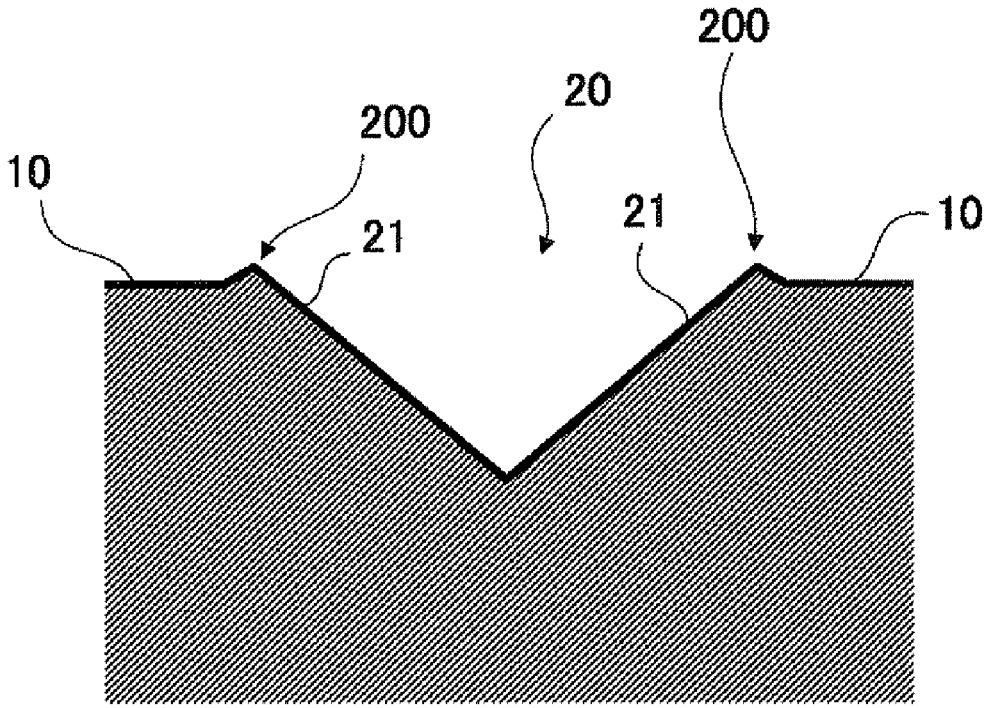

The ridged portions 200 may be projections produced in the process of forming the scoreline 20 or the ones formed by machining the projections. FIGS. 5A and 5B are explanatory views illustrating another example of the method of forming the ridged portions 200. After a face member is prepared, a temporary scoreline 20' is primarily formed, as shown in FIG. 5A. At this time, projections BR are purposely formed in the edges of the scoreline 20'. When the scoreline 20' is formed by a cutting process by an NC milling machine, the projections BR are, for example, burrs formed by rough machining in which, for example, the feed speed of a tool is relatively high or a large cutting depth is set. Ridged portions 200 are formed by appropriately adjusting the shapes of the projections BR, as shown in FIG. 5B. Examples of a method of forming the ridged portions 200 from the projections BR are a cutting process, a polishing process, a shotblasting process, a shot peening process, and chemical processes such as acid washing. The projections BR can also be used intact as the ridged portions 200 depending on their shapes. In this case, both the scoreline 20 and the ridged portions 200 can be formed at once.

Second Embodiment

Figure 6A:
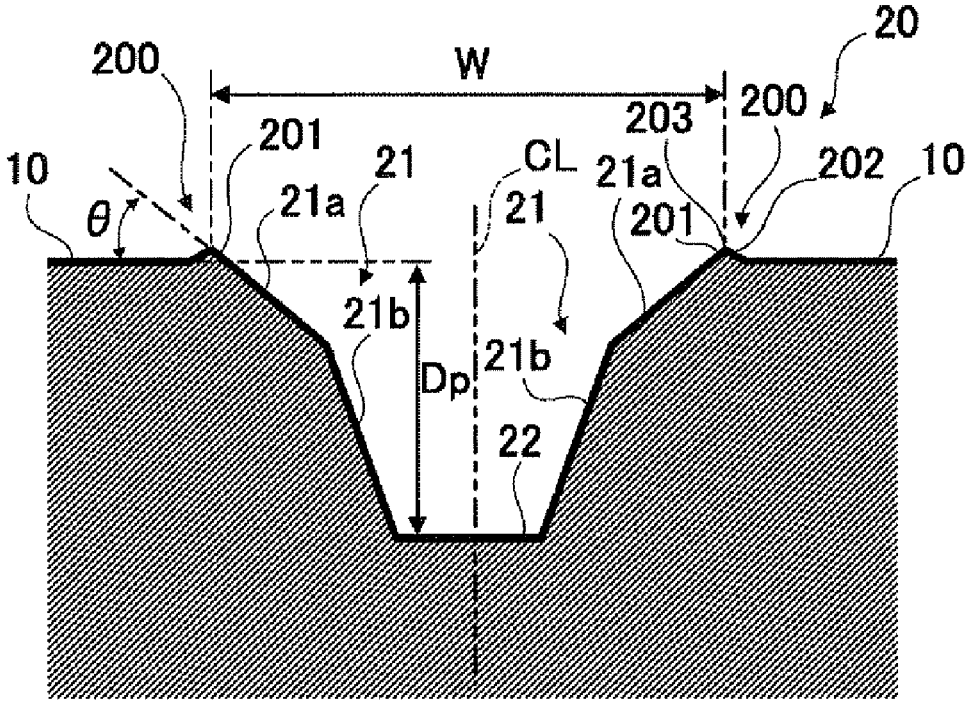
FIG. 6A is a sectional view illustrating another example of the cross-sectional shape of the scoreline 20.

Although the scoreline 20 has a roughly V-shaped cross-section in the above-described first embodiment, another cross-sectional shape can also be adopted. FIG. 6A is a sectional view illustrating another example of the cross-sectional shape of a scoreline 20. The same reference numerals as in the above-described first embodiment denote the same constituent components of the scoreline 20 in the second embodiment, and a description thereof will not be given. Referring to FIG. 6A, the scoreline 20 has a pair of side walls 21 and a bottom wall 22. In this embodiment, the side walls 21 include a side wall 21*a* on the side of a face 10 and a side wall 21*b* on the side opposite to the face 10. An angle θ is of the side wall 21*a* with respect to the face 10.

The side wall 21*a* has its upper end which is continuous with an inner side wall 201 of a ridged portion 200. In this embodiment, the side wall 21*a* and inner side wall 201 are continuous with each other on nearly the same plane. Hence, the angle θ is equal to an angle θg. The side wall 21*b* has its upper end which is continuous with the lower end of the side wall 21*a*, and its lower end which is continuous with the bottom wall 22. The bottom wall 22 is parallel to the face 10.

In this embodiment, a virtual circle C1 in the two-circle rule need only be assumed to be inscribed in the side wall 21*a* of the side walls 21. Also, a cross-sectional area A of the scoreline 20 is the area of the region surrounded by a virtual line which connects the pair of side walls 21 (the upper side wall 21*a* and lower side wall 21*b*), the bottom wall 22, the pair of side walls 201, and a pair of tops 203. In this embodiment, the volume of the scoreline 20 is easily increased because the cross-sectional area of the scoreline 20 in this embodiment is larger than that of the scoreline 20 in the above-described first embodiment.

Third Embodiment

The amount of backspin on a struck ball can be further increased by roughing a face 10. Examples of a method of roughing the face 10 are milling and shotblasting. The amount of backspin is effectively increased as long as the face 10 has a surface roughness equal to an arithmetic average roughness (Ra) of 3.0 μm or more. However, note that it is stipulated that the face of an athletic golf club should have a surface roughness equal to an arithmetic average roughness (Ra) of 4.57 μm or less. Thus, when the golf club head 1 is used for an athletic golf club, the face naturally has a surface roughness equal to an arithmetic average roughness (Ra) of 4.57 μm or less.

Example

Thirteen golf club heads #1 to #13 having different specifications such as those associated with scorelines were fabricated, and test shots took place using golf clubs equipped with the respective golf club heads. Each golf club head was a wedge with a loft angle of 58°. FIG. 7 is a table showing the specifications of golf club heads #1 to #13 used in an experiment involved.

Figure 6B:
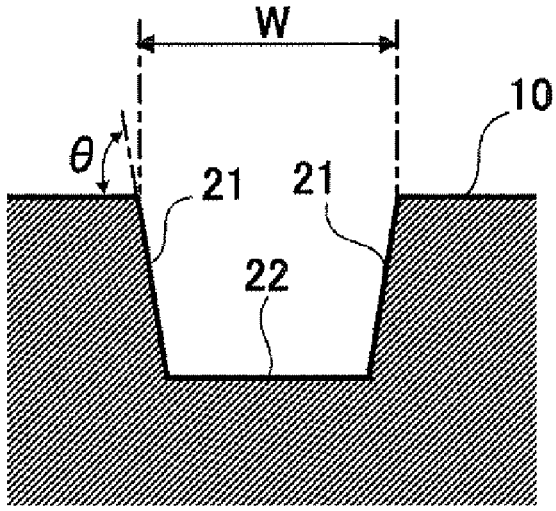
FIG. 6B is a sectional view showing the cross-sectional shape of a scoreline of golf club head #1 used in an experiment involved.

Referring to FIG. 7, "Cross-sectional Shape" indicates the cross-sectional shapes of scorelines of the respective golf club heads. "Single-step Side Wall" in golf club head #1 indicates that a golf club head has scorelines with a cross-sectional shape formed by a bottom wall 22 and side walls 21 each of which forms a single face, shown in FIG. 6B. Golf club head #1 has no ridged portions 200. "Two-step Side Wall" in golf club heads #2 to #13 indicates that a golf club head has scorelines with a cross-sectional shape formed by a bottom wall 22 and side walls 21 each of which forms two faces (side walls 21*a* and 21*b*), as shown in FIG. 6A. Note that the scorelines of golf club heads #2 and #3 have no ridged portions 200. Referring to FIG. 7, "θ", "H", and "W" indicate the angle θ, the height H of the ridged portion 200, and the width W of the scoreline 20, respectively, shown in FIGS. 2, 3A and 6A. "Ra" indicates the arithmetic average roughness of the face; "P", the pitch of scorelines; and "A", the cross-sectional area of a scoreline.

FIG. 8 is a table showing the rule conformities of golf club heads #1 to #13 and the experimental results obtained using them. "Rule Conformity" indicates the rule conformity of an athletic golf club head. "Surface Roughness Rule" is satisfied when the face has a surface roughness equal to an arithmetic average roughness (Ra) of 4.57 μm or less and to a maximum height Ry of 25 μm or less.

An experiment (test shots) took place by striking each golf club a plurality of times from a spot spaced apart from the green by 40 yards toward the green. The amounts of backspin on a golf ball were evaluated relatively on a scale of five grades A to E (A is best and E is worst) based on the degrees of stop of the golf ball on the green by visual observation. The degrees of scratch of the golf ball were evaluated relatively on a scale of five grades A to E (A is best and E is worst) by visual observation as well. The amount backspin on a ball and the degree of scratch of the ball are preferably C or higher.

Golf club head #1 has an angle θ of 75° and this means that it produces a large amount of backspin on a ball but scratches the ball to a large degree. Thus, the angle θ is desirably 70° or less. At the same time, the angle θ is preferably 45° or more from the viewpoint of increasing the amount of backspin, as can be seen from a comparison between golf club heads #7 and #13. The formation of ridged portions 200 increases the amount of backspin, as can be seen from a comparison between golf club head #2 and golf club heads #7 to #9 and a comparison between golf club head #3 and golf club heads #10 to #13.

The experimental results obtained using golf club heads #7 to #9 reveal that the amount of backspin on a ball increases in proportion to the height H of the ridged portion 200 but the degree of scratch of the ball increases, so golf club head #9 has grade E in the degree of scratch. Thus, the height H is desirably 20 μm or less from the viewpoint of making a golf club head less prone to scratch a ball. The experimental results obtained using golf club heads #10 to #13 reveal that the height H is desirably 5 μm or more from the viewpoint of ensuring a given amount of backspin.

As for the surface roughness Ra, the experimental results obtained using golf club heads #4 to #6 reveal that the amount of backspin increases as the face becomes rougher, so golf club head #5 (Ra=3.5 μm) had an especially good result (grade B) while satisfying the surface roughness rule. Thus, the surface roughness Ra is preferably 3.0 μm or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-143671, filed Jun. 16, 2009, which is hereby incorporated by reference herein in its entirety.

What is claimed is:

1. A golf club head comprising a plurality of scorelines formed in a face thereof, wherein an angle θ of a side wall of the scoreline with respect to the face is not more than 70°, an edge of the scoreline includes a ridged portion projecting from the face, a height H of said ridged portion from the face satisfies:

$$5\ \mu m \leqq H \leqq 20\ \mu m,$$

said ridged portion includes a first side wall on a side of the scoreline and a second side wall on a side opposite to the scoreline, and an interior angle θg between the face and said first side wall and an interior angle θt between the face and said second side wall have a relation:

$$\theta g > \theta t.$$

2. A golf club head comprising a plurality of scorelines formed in a face thereof, wherein an angle θ of a side wall of the scoreline with respect to the face is not more than 70°, an edge of the scoreline includes a ridged portion projecting from the face, a height H of said ridged portion from the face satisfies:

$$5\ \mu m \leqq H \leqq 20\ \mu m,$$

a cross-sectional area A ($inch^2$) of the scoreline, a width W (inch) of the scoreline measured by a 30 degrees measurement rule, and a distance S (inch) between adjacent scorelines satisfy:

$$A/(W+S) \leqq 0.0025$$

letting P1 and P2 be two intersections between a contour of a portion, in the edge of the scoreline, which falls outside a second virtual circle which has a radius of 0.011 inch and is concentric with a first virtual circle which has a radius of 0.010 inch and is inscribed in both the side wall of the scoreline and the face, and Cp be a center point of both the first virtual circle and the second virtual circle, an included angle between a virtual line which connects the point P1 and the point Cp and a virtual line which connects the point P2 and the point Cp is not more than 10°, and the edge of the scoreline falls within a circle which has a radius of 0.0113 inch and is concentric with both the first virtual circle and the second virtual circle.

3. A golf club head comprising a plurality of scorelines formed in a face thereof, wherein an angle θ of a side wall of the scoreline with respect to the face is not more than 70°, an edge of the scoreline includes a ridged portion projecting from the face, a height H of said ridged portion from the face satisfies:

$$5\ \mu m \leqq H \leqq 20\ \mu m,$$

the ridged portion extends lengthwise along the edge of the scoreline between a toe portion and a heel portion, a cross-sectional area A (inch2) of the scoreline, a width W (inch) of the scoreline measured by a 30 degrees measurement rule, and a distance S (inch) between adjacent scorelines satisfy:

$$A/(W+S) \leqq 0.0025$$

letting P1 and P2 be two intersections between a contour of a portion, in the edge of the scoreline, which falls outside a second virtual circle which has a radius of 0.011 inch and is concentric with a first virtual circle which has a radius of 0.010 inch and is inscribed in both the side wall of the scoreline and the face, and Cp be a center point of both the first virtual circle and the second virtual circle, an included angle between a virtual line which connects the point P1 and the point Cp and a virtual line which connects the point P2 and the point Cp is not more than 10°, and the edge of the scoreline falls within a circle which has a radius of 0.0113 inch and is concentric with both the first virtual circle and the second virtual circle.

* * * * *